US008655200B2

(12) United States Patent
Kawai

(10) Patent No.: US 8,655,200 B2
(45) Date of Patent: Feb. 18, 2014

(54) IMAGE FORMING DEVICE, DEVICE AND SYSTEM FOR CONTROLLING AN IMAGE FORMING DEVICE, AND RECORDING MEDIUM

(75) Inventor: Atsushi Kawai, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 130 days.

(21) Appl. No.: 13/046,219

(22) Filed: Mar. 11, 2011

(65) Prior Publication Data

US 2011/0229157 A1 Sep. 22, 2011

(30) Foreign Application Priority Data

Mar. 18, 2010 (JP) ..... 2010-63090

(51) Int. Cl.
*G03G 15/08* (2006.01)

(52) U.S. Cl.
USPC ..... 399/27; 399/30

(58) Field of Classification Search
None
See application file for complete search history.

(56) References Cited

U.S. PATENT DOCUMENTS

| | | | | |
|---|---|---|---|---|
| 4,502,778 | A * | 3/1985 | Dodge et al. | 399/30 |
| 5,943,525 | A * | 8/1999 | Endo et al. | 399/27 |
| 6,233,409 | B1 * | 5/2001 | Haines et al. | 399/10 |
| 2008/0205908 | A1 | 8/2008 | Matsuura et al. | |
| 2008/0278754 | A1 * | 11/2008 | Hibino | 358/1.15 |

FOREIGN PATENT DOCUMENTS

| | | | | |
|---|---|---|---|---|
| JP | 2006-313226 | | 11/2006 | |
| JP | 2007-57632 | | 3/2007 | |
| JP | 2008-210112 | | 9/2008 | |
| JP | 2008-210112 | A * | 11/2008 | G06F 3/12 |

OTHER PUBLICATIONS

Notification of Reasons of Rejection mailed Dec. 11, 2012, directed to Japanese Application No. 2010-063090; 13 pages.

* cited by examiner

*Primary Examiner* — Clayton E Laballe
*Assistant Examiner* — Jas Sanghera
(74) *Attorney, Agent, or Firm* — Morrison & Foerster LLP

(57) ABSTRACT

A controlling system comprising an image forming device and a controlling device for the image forming device, the image forming device having an indicating device which can indicate that a toner cartridge is in a toner near empty state and a communication part for communicating with the controlling device via a communication network, and when the toner near empty state of the toner cartridge is detected, the communication part transmits the information to the controlling device. The controlling device has a controlling condition table in which a controlling condition set for each image forming device to be controlled is recorded, and when a toner near empty signal is received from the image forming device to be controlled, the controlling device refers to the controlling condition of the image forming device recorded in the table, and outputs or does not output a toner near empty indication instruction signal depending on the controlling condition. When the image forming device receives the toner near empty indication instruction signal, it displays so on the indicating device.

16 Claims, 5 Drawing Sheets

IMAGE FORMING DEVICE, DEVICE AND SYSTEM FOR CONTROLLING AN IMAGE FORMING DEVICE, AND RECORDING MEDIUM

CROSS-REFERENCE TO RELATED APPLICATION

This invention is based on Japanese patent application No. 2010-63090 filed in Japan on Mar. 18, 2010, the entire content of which is hereby incorporated by reference.

BACKGROUND OF THE INVENTION

1. Field of the Invention

The present invention relates to an image forming device such as a copying machine, a printer, a facsimile machine, or a multifunctional machine produced by combining two or more of these, and further to a controlling device for the image forming device and a controlling system for the image forming device, and further to a recording medium having a program recorded thereon for making a computer execute a control procedure in the image forming device, controlling device and controlling system, respectively.

2. Description of Related Art

As an image forming device such as a copying machine, a printer, a facsimile machine, or a multifunctional machine produced by combining two or more of these is known an image forming device which can form an electrostatic latent image on an image carrying member, can form a toner image by developing the electrostatic latent image with a developing device having a developer therein, and can supply a toner from a replaceably attached toner cartridge to the developing device, and comprises a toner level detecting device for detecting a level of toner in the toner cartridge, the toner level detecting device being capable of detecting a toner near empty state indicating that the toner cartridge will be shortly empty of toner, and an indicating device which can indicate that the toner cartridge is in the near empty state.

In a conventional image forming device of this type, when the toner level detecting device detects the toner cartridge is near empty of toner, the information that the toner cartridge is near empty is indicated on the indicating device, and is notified to the user of the image forming device.

The user learns from the indication that the toner cartridge is near empty, and prepares a toner cartridge replacement, or order a toner cartridge to obtain a toner cartridge replacement if no toner cartridge is in stock before the toner cartridge is emptied and image formation is no longer possible.

How much grace period is allowed from the toner near empty detection to the toner cartridge replacement varies depending on the presence or absence of the toner cartridge replacement. As for this point, Japanese Unexamined Patent Publication No. 2006-313226 (JP2006-313226A) describes switching the timing for detecting that the toner is near empty by stock information of the toner cartridge stored in the body of the image forming device.

Meanwhile, control of an image forming device is increasingly conducted by building a remote management system, in which an image forming device and a controlling device is connected via a communication line and information about control is exchanged between the image forming device and the controlling device.

The controlling device is often located at a sales company of the image forming device or a service company which provides service such as maintenance. The controlling device uses various information including the information that the toner is near empty from the image forming devices of a plurality of users for maintaining and controlling the image forming devices.

With such an image forming device which is connected to such a controlling device, the controlling device can recognize that the toner is near empty, and when no toner cartridge replacement is in stock on the user side of the image forming device, a toner cartridge replacement can be provided accordingly rapidly. This therefore eliminates the necessity of switching the timing for detecting that the toner is near empty depending on the stock status of the toner cartridge.

In either case, when the toner empty indication is indicated, the user may replace the toner cartridge in some cases although the toner is remaining in the toner cartridge.

In such a case, the cartridge with toner remaining inside is thrown away. From the perspective of resource saving, it is desirable that the toner cartridge is replaced only when the amount of toner left in the toner cartridge is as low as possible. In addition, when there is a billing contract between the sales company of the image forming device and the user that a certain amount is paid per one sheet of image formed, from the viewpoint of the sales company, it is desirable that the toner cartridge is replaced only when the amount of toner left in the toner cartridge is as low as possible.

Even so, if the toner near empty indication is not indicated on the indicating device, the toner cartridge is emptied (the state that printing is inhibited) before the user knows that the toner is near empty, and therefore image formation is no longer feasible. The user needs to replace the toner cartridge after such an event has occurred, and in case of the user who has no toner cartridge replacement in stock, the state that no image formation can be carried out lasts after he/she orders a cartridge for replacement until it arrives.

SUMMARY OF THE INVENTION

A first object of the present invention is to provide an image forming device which can form an electrostatic latent image on an image carrying member, develop the electrostatic latent image by a developing device having a developer therein to form a toner image, and supply a toner from a replaceably attached toner cartridge to the developing device, and comprising a toner level detecting device for detecting a level of toner in the toner cartridge, the toner level detecting device being capable of detecting a toner near empty state indicating that the toner cartridge is near empty of toner and will be shortly empty, and having an indicating device which can indicate the toner near empty state and a communication part for communicating with a controlling device for the image forming device via a communication network, in which when the toner level detecting device detects the toner near empty state, an inquiry can be made to the controlling device whether or not to indicate a toner near empty indication, for example, if the toner near empty indication is necessary according to a controlling condition for the image forming device set in the controlling device side and other information, the toner near empty indication is indicated on the indicating device by an instruction from the controlling device, if it is not necessary, the toner near empty indication is not indicated on the indicating device, and when the toner near empty indication is indicated, a toner cartridge replacement can be prepared on the image forming device side so that an image can be formed without uselessly spending time for preparation of the toner cartridge, and when the toner near empty indication is not indicated, replacement of the toner cartridge by the user wastefully too early due to the indication of the toner near empty indication can be suppressed, the toner can be saved accordingly, offering good usability as a whole due to these advantages.

A second object of the present invention is to provide a controlling device for the image forming device according to the present invention mentioned above, wherein when the toner cartridge in the image forming device is in the near empty state, the controlling device can instruct the image forming device to or not to indicate the toner near empty indication by determining whether or not to indicate the toner near empty indication on the image forming device depending on a controlling condition for the image forming device set in the controlling device, when the controlling device instructs the image forming device to indicate the indication of the toner near empty indication, a user of the image forming device can prepare a toner cartridge replacement with sufficient time and thus can carry out image formation without spending unnecessary time, when the controlling device does not instruct the image forming device to indicate the indication of the toner near empty indication, replacement of the toner cartridge by the user wastefully too early due to the indication of the toner near empty indication can be suppressed, the toner can be saved accordingly, the image forming device can be imparted good usability as a whole due to these advantages.

Furthermore, a third object of the present invention is to provide a system for controlling an image forming device comprising the image forming device according to the present invention and the controlling device according to the present invention, wherein when the toner cartridge in the image forming device is in the near empty state, whether or not to indicate the toner near empty indication on the image forming device is determined depending on the controlling condition for the image forming device set in the controlling device side, the controlling device is capable of instructing or not instructing the image forming device to indicate the toner near empty indication, when the toner near empty indication is instructed, a user of the image forming device is allowed sufficient time to prepare a toner cartridge replacement, and images can be thus formed without spending unnecessary time for preparation of the toner cartridge, when the indication of the toner near empty indication is not instructed, premature replacement of the toner cartridge by the user due to the indication of the toner near empty indication can be suppressed, the toner can be saved accordingly, the image forming device can be imparted good usability as a whole due to these advantages.

A fourth object of the present invention is to provide a computer-readable recording medium having a program recorded thereon for making a computer comprised in the image forming device according to the present invention execute at least a procedure relating to the toner near empty indication, a fifth object of the present invention is to provide a computer-readable recording medium having a program recorded thereon for making a computer comprised in the controlling device for the image forming device according to the present invention execute at least a procedure relating to the toner near empty indication in the image forming device, and a sixth object of the present invention is to provide a computer-readable recording medium having a program recorded thereon for making a computer comprised in the controlling device in a system for controlling the image forming device according to the present invention execute at least a procedure relating to the toner near empty indication in the image forming device.

In order to achieve the first object, one aspect of the present invention is to provide an image forming device being capable of forming an electrostatic latent image on an image carrying member; being capable of forming a toner image by developing the electrostatic latent image with a developing device having a developer therein and being capable of supplying a toner from a replaceably attached toner cartridge to the developing device, and comprising a toner level detecting device for detecting a level of toner in the toner cartridge, the toner level detecting device being capable of detecting a toner near empty state indicating that the toner cartridge will be shortly empty of toner, the image forming device having an indicating device which can indicate that the toner cartridge is in the near empty state and a communication part for communicating with a controlling device for the image forming device via a communication network, the image forming device being so arranged that when the toner level detecting device detects the toner near empty state, a toner near empty signal is output from the communication part to the controlling device; when the communication part receives a toner near empty indication instruction signal instructing that a toner near empty indication should be indicated on the indicating device from the controlling device which has received the toner near empty signal, the indicating device indicates the toner near empty indication; and when the communication part does not receive the toner near empty indication instruction signal although the toner near empty signal is output to the controlling device, the indicating device does not indicate the toner near empty indication.

In order to achieve the second object, another aspect of the present invention is to provide a controlling device for the image forming device according to the present invention mentioned above, which has a controlling condition table recording a controlling condition set for each image forming device to be controlled and a communication part for communicating with the image forming device to be controlled via the communication network, the controlling device referring to the controlling condition for controlling the image forming device recorded in the controlling condition table for the image forming device when the communication part receives the toner near empty signal from the image forming device to be controlled, outputting the toner near empty indication instruction signal for instructing that the toner near empty indication should be indicated on the indicating device to the image forming device when the image forming device is an image forming device which should indicate the toner near empty indication on the indicating device according to the controlling condition, and not outputting the indication instruction signal to the image forming device when the image forming device is an image forming device which should not indicate the toner near empty indication on the indicating device according to the controlling condition.

In order to achieve the third object, still another aspect of the present invention is to provide a system for controlling an image forming device comprising the image forming device and a controlling device for the image forming device, the image forming device being capable of forming an electrostatic latent image on an image carrying member; being capable of developing the electrostatic latent image with a developing device having a developer therein to form a toner image and being capable of supplying a toner from a replaceably attached toner cartridge to the developing device, and comprising a toner level detecting device for detecting a level of toner in the toner cartridge, the toner level detecting device being capable of detecting a toner near empty state indicating that the toner cartridge will be shortly empty of toner, and having an indicating device which can indicate that the toner cartridge is in the toner near empty state and a communication part for communicating with the controlling device via a communication network, the communication part outputting a toner near empty signal to the controlling device when the toner level detecting device detects the toner near empty state, the indicating device indicating a toner near empty indication when the communication part receives a toner near empty indication instruction signal which instructs that the toner near empty indication should be indicated on the indicating device from the controlling device which has received the toner near empty signal, the indicating device not indicating the toner near empty indication when the communication part does not receive the toner near empty indication instruction signal although the toner near empty signal is output to the controlling device, the controlling device having a controlling condition table recording a controlling condition set for each image forming device to be controlled and a communication part for communicating with the image forming device to be controlled via the communication network, the controlling device referring to the controlling condition for controlling the image forming device recorded in the controlling condition table for the image forming device when the communication part receives the toner near empty signal from the image forming device to be controlled, outputting the toner near empty indication instruction signal for instructing that the toner near empty indication should be indicated on the indicating device to the image forming device when the image forming device is an image forming device which should indicate the toner near empty indication on the indicating device according to the controlling condition, and not outputting the indication instruction signal to the image forming device when the image forming device is an image forming device which should not indicate the toner near empty indication on the indicating device according to the controlling condition.

In order to achieve the fourth object, still another aspect of the present invention is to provide a computer-readable recording medium having a program recorded thereon for making a computer comprised in an image forming device being capable of forming a toner image execute the steps of:

transmitting a toner near empty signal to a controlling device for the image forming device when a toner level detecting device included in the image forming device detects that a toner cartridge for supplying toner is in a toner near empty state, indicating a toner near empty indication on a indicating device of the image forming device upon receiving a toner near empty indication instruction signal from the controlling device, and not indicating the toner near empty indication on the indicating device when the toner near empty indication instruction signal is not received from the controlling device in spite of the toner near empty signal transmission to the controlling device.

In order to achieve the fifth object, still another aspect of the present invention is to provide a computer-readable recording medium having a program recorded thereon for making a computer comprised in a controlling device for an image forming device being capable of forming a toner image execute the steps of:

receiving a toner near empty signal from the image forming device to be controlled, referring to a condition for controlling the image forming device recorded in a controlling condition table in the controlling device for the image forming device upon receipt of the toner near empty signal from the image forming device, outputting a toner near empty indication instruction signal instructing that a toner near empty indication should be indicated on a indicating device of the image forming device to the image forming device when the image forming device is an image forming device which should indicate the toner near empty indication on the indicating device according to the controlling condition; and not outputting the toner near empty indication instruction signal to the image forming device when the image forming device is an image forming device which should not indicate the toner near empty indication on the indicating device according to the controlling condition.

In order to achieve the sixth object, still another aspect of the present invention is to provide a computer-readable recording medium having a program recorded thereon for making a computer comprised in a controlling device for a image forming device being capable of forming a toner image in a system for controlling the image forming device execute the steps of:

receiving a toner near empty signal from the image forming device to be controlled, referring to a condition for controlling the image forming device recorded in a controlling condition table in the controlling device for the image forming device upon receipt of the toner near empty signal from the image forming device, outputting a toner near empty indication instruction signal instructing that a toner near empty indication should be indicated on a indicating device of the image forming device to the image forming device when the image forming device is an image forming device which should indicate the toner near empty indication on the indicating device according to the controlling condition; and not outputting the toner near empty indication instruction signal to the image forming device when the image forming device is an image forming device which should not indicate the toner near empty indication on the indicating device according to the controlling condition.

The foregoing and other objects, features, aspects and advantages of the present invention will become more apparent from the following detailed description of the preferred embodiments of the present invention when taken in conjunction with accompanying drawings.

DESCRIPTION OF THE PREFERRED EMBODIMENTS

Figure 1:
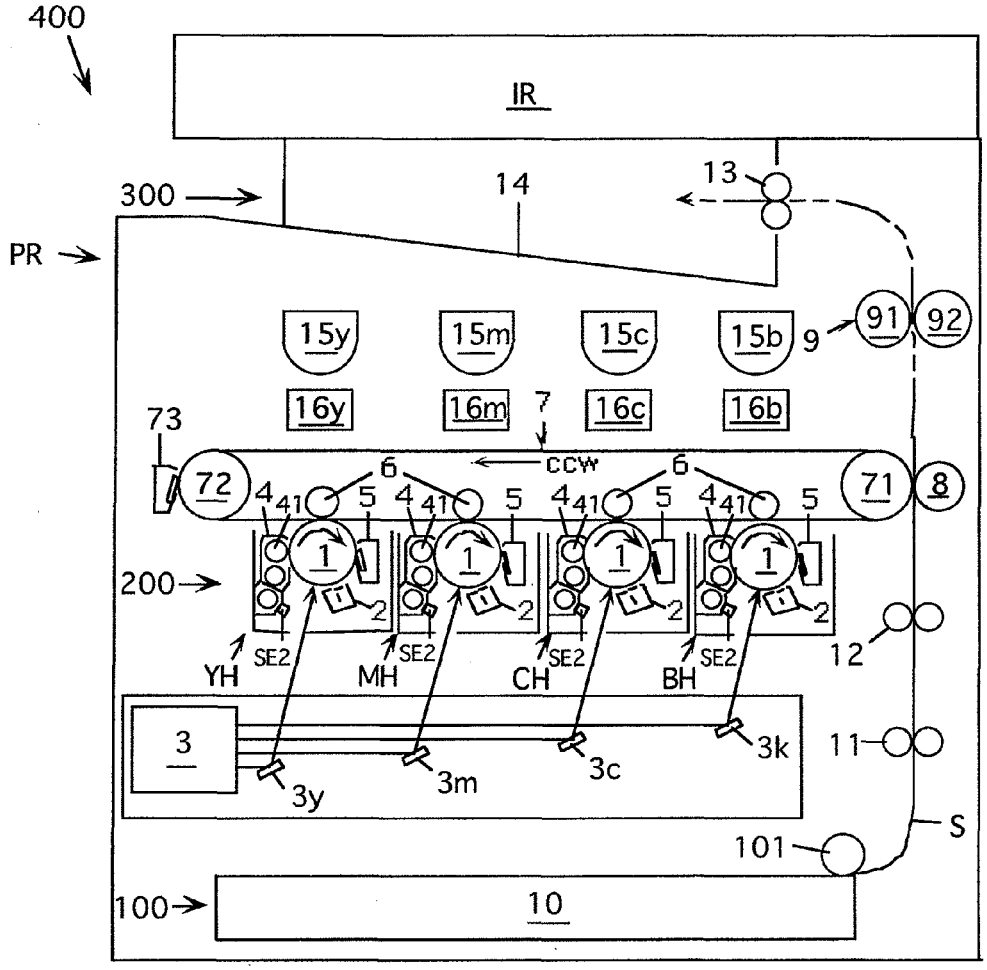
FIG. 1 shows an example of an image forming device according to the present invention.

Embodiments of the present invention will be described below.

An image forming device, a controlling device for an image forming device, a system for controlling an image forming device and computer-readable recording mediums of embodiments of the present invention are the followings, respectively.

<Image Forming Device>

An image forming device being capable of forming an electrostatic latent image on an image carrying member; being capable of forming a toner image by developing the electrostatic latent image with a developing device having a developer therein and being capable of supplying a toner from a replaceably attached toner cartridge to the developing device, and comprising a toner level detecting device for detecting a level of toner in the toner cartridge, the toner level detecting device being capable of detecting a toner near empty state indicating that the toner cartridge will be shortly empty of toner, the image forming device having an indicating device which can indicate that the toner cartridge is in the near empty state and a communication part for communicating with a controlling device for the image forming device via a communication network, the image forming device being so arranged that when the toner level detecting device detects the toner near empty state, a toner near empty signal is output from the communication part to the controlling device; when the communication part receives a toner near empty indication instruction signal instructing that a toner near empty indication should be indicated on the indicating device from the controlling device which has received the toner near empty signal, the indicating device indicates the toner near empty indication; and when the communication part does not receive the toner near empty indication instruction signal although the toner near empty signal is output to the controlling device, the indicating device does not indicate the toner near empty indication.

<Controlling Device for an Image Forming Device>

A controlling device for the image forming device described above, which has a controlling condition table recording a controlling condition set for each image forming device to be controlled and a communication part for communicating with the image forming device to be controlled via the communication network, the controlling device referring to the controlling condition for controlling the image forming device recorded in the controlling condition table for the image forming device when the communication part receives the toner near empty signal from the image forming device to be controlled, outputting the toner near empty indication instruction signal for instructing that the toner near empty indication should be indicated on the indicating device to the image forming device when the image forming device is an image forming device which should indicate the toner near empty indication on the indicating device according to the controlling condition, and not outputting the indication instruction signal to the image forming device when the image forming device is an image forming device which should not indicate the toner near empty indication on the indicating device according to the controlling condition.

Herein, examples of the condition for controlling the image forming device set in the controlling device include such that "when the state that the toner cartridge is near empty, a toner cartridge replacement is delivered to the user without waiting for the user's order of replacement", and that "when the state that the toner cartridge is near empty, a toner cartridge replacement is ordered at the user's responsibility". In addition, as for the presence or absence of the toner near empty indication instruction from the controlling device, an example can be shown such that the indication instruction is not emitted in case of the former condition to prevent premature replacing of the toner cartridge, while in case of the latter condition, the indication instruction is emitted to allow the user plenty of time to order a toner cartridge replacement.

In the controlling device for the image forming device, examples of controlling conditions for determining whether or not to output the toner near empty indication instruction signal, which are recorded in the controlling condition table for each image forming device to be controlled, include the followings:

At least one condition selected from (1) condition that an automatic delivery contract to deliver a toner cartridge replacement to a user of the image forming device when the toner near empty state is detected in the image forming device is made (condition 2), (2) condition that even when the toner near empty signal is received, the image forming device which has emitted the signal is placed under circumstances where a toner cartridge replacement is always kept in stock (condition 2);

(3) condition that even when the toner near empty signal is received, a billing contract on a pay-per-page of image formation basis is made for the image forming device which has emitted the signal (condition 3);

(4) condition that when the toner near empty state is detected in the image forming device which has emitted the toner near empty signal, only a predetermined low amount of toner is left in the toner cartridge (condition 4); and (5) condition that it can be assumed that the toner cartridge will be replaced shortly after the toner near empty state is detected according to history of toner cartridge replacement relating to the image forming device which has emitted the toner near empty signal (condition 5)

The controlling device, for example, does not output the toner near empty indication instruction signal to the image forming device for which at least one of the conditions (1), (2), (3) and (5) is set even when the toner near empty signal is transmitted from the image forming device, while it can output the toner near empty indication instruction signal to the image forming device for which the condition (4) is set when the toner near empty signal is transmitted from the image forming device.

As for the condition (1), there is a promise to deliver a toner cartridge to the user when the toner near empty state is detected. Therefore, a toner cartridge replacement will be delivered to the user without indicating the toner near empty indication (to prevent premature replacement of the toner cartridge).

As for the condition (2), a toner cartridge replacement is always kept in stock at the user's location, and a toner cartridge empty state can be quickly coped with. Therefore, the toner near empty indication need not be indicated.

As for the condition (3), in case of that condition setting, it is often the case that a toner cartridge replacement is kept at the user's location, and the toner cartridge empty state can be quickly coped with. Therefore, the toner near empty indication need not be indicated.

As for the condition (4), in some types of the image forming devices, only a predetermined low amount of toner may be left in the toner cartridge when the toner near empty state is detected. Under such conditions, it is preferable to show the indication in order to prompt the user to get a toner replacement.

As for the condition (5), it is preferable that the toner near empty indication is not indicated to prevent the toner cartridge from being replaced prematurely.

The above controlling device may have a delivery instruction communication part for communicating with a toner cartridge delivery control device via a communication network. In such a case, the image forming device which transmits the toner near empty signal may be so constituted that if there is the setting of condition (1) as the condition for controlling the image forming device recorded in the controlling condition table, a signal instructing the indication of the toner near empty indication is not output to the image forming device and a signal instructing that a toner cartridge replacement should be delivered to the user of the image forming device is output to the toner cartridge delivery control device.

<System for Controlling Image Forming Device>

A system for controlling an image forming device comprising the image forming device and a controlling device for the image forming device, the image forming device being capable of forming an electrostatic latent image on an image support; being capable of developing the electrostatic latent image with a developing device having a developer therein to form a toner image and being capable of supplying a toner from a replaceably attached toner cartridge to the developing device, and comprising a toner level detecting device for detecting a level of toner in the toner cartridge, the toner level detecting device being capable of detecting a toner near empty state indicating that the toner cartridge will be shortly empty of toner, and having an indicating device which can indicate that the toner cartridge is in the toner near empty state and a communication part for communicating with the controlling device via a communication network, the communication part outputting a toner near empty signal to the controlling device when the toner level detecting device detects the toner near empty state, the indicating device indicating a toner near empty indication when the communication part receives a toner near empty indication instruction signal which instructs that the toner near empty indication should be indicated on the indicating device from the controlling device which has received the toner near empty signal, the indicating device not indicating the toner near empty indication when the communication part does not receive the toner near empty indication instruction signal although the toner near empty signal is output to the controlling device, the controlling device having a controlling condition table recording a controlling condition set for each image forming device to be controlled and a communication part for communicating with the image forming device to be controlled via the communication network, the controlling device referring to the controlling condition for controlling the image forming device recorded in the controlling condition table for the image forming device when the communication part receives the toner near empty signal from the image forming device to be controlled, outputting the toner near empty indication instruction signal for instructing that the toner near empty indication should be indicated on the indicating device to the image forming device when the image forming device is an image forming device which should indicate the toner near empty indication on the indicating device according to the controlling condition, and not outputting the indication instruction signal to the image forming device when the image forming device is an image forming device which should not indicate the toner near empty indication on the indicating device according to the controlling condition.

Also in this controlling system, a controlling condition for determining whether or not to output the toner near empty indication instruction signal recorded in the controlling condition table in the controlling device for each image forming device to be controlled may be at least one selected from the following conditions:

(1) condition that an automatic delivery contract to deliver a toner cartridge replacement to a user of the image forming device when the toner near empty state is detected in the image forming device is made (condition (1));

(2) condition that even when the toner near empty signal is received, the image forming device which has emitted the signal is placed under circumstances where a toner cartridge replacement is always kept in stock (condition 2);

(3) condition that even when the toner near empty signal is received, a billing contract on a pay-per-page of image formation basis is made for the image forming device which has emitted the signal (condition 3);

(4) condition that when the toner near empty state is detected in the image forming device which has emitted the toner near empty signal, only a predetermined low amount of toner is left in the toner cartridge (condition 4); and (5) condition that it can be assumed that the toner cartridge will be replaced shortly after the toner near empty state is detected according to history of toner cartridge replacement relating to the image forming device which has emitted the toner near empty signal (condition 5).

The controlling device in the controlling system described above may be also so arranged that the toner near empty indication instruction signal is not output to the image forming device for which at least one of the conditions (1), (2), (3) and (5) is set even when the toner near empty signal is transmitted from the image forming device, and the toner near empty indication instruction signal is output to the image forming device for which the condition (4) is set when the toner near empty signal is transmitted from the image forming device.

The above controlling system may further comprise a toner cartridge delivery control device having a communication part for communicating with the controlling device through a communication network.

In such a case, the controlling device may be so arranged that it has a delivery instruction communication part for communicating with the toner cartridge delivery control device through the communication network, and as for the image forming device which transmits the toner near empty signal, if the condition for controlling the image forming device recorded in the controlling condition table includes the setting of the condition (1), a signal instructing the indication of the toner near empty indication is not output to the image forming device, and a signal instructing that a toner cartridge replacement should be delivered to the user of the image forming device is output to the toner cartridge delivery control device.

<Recording Medium>

(1) First Medium

A computer-readable recording medium having a program recorded thereon for making a computer comprised in the above-mentioned image forming device execute the steps of:

transmitting the toner near empty signal to the controlling device for the image forming device when the toner level detecting device included in the image forming device detects that the toner cartridge for supplying toner is in the toner near empty state, indicating the toner near empty indication on the indicating device of the image forming device upon receiving the toner near empty indication instruction signal from the controlling device, and not indicating the toner near empty indication on the indicating device when the toner near empty indication instruction signal is not received from the controlling device in spite of the toner near empty signal transmission to the controlling device.

(2) Second Medium

A computer-readable recording medium having a program recorded thereon for making a computer comprised in the above mentioned controlling device for the image forming device execute the steps of:

receiving the toner near empty signal from the image forming device to be controlled, referring to the condition for controlling the image forming device recorded in the controlling condition table in the controlling device for the image forming device upon receipt of the toner near empty signal from the image forming device, outputting the toner near empty indication instruction signal instructing that the toner near empty indication should be indicated on the indicating device of the image forming device to the image forming device when the image forming device is an image forming device which should indicate the toner near empty indication on the indicating device according to the controlling condition; and not outputting the toner near empty indication instruction signal to the image forming device when the image forming device is an image forming device which should not indicate the toner near empty indication on the indicating device according to the controlling condition.

This medium may further has a program recorded thereon for making the computer in the controlling device execute the step of outputting to a toner cartridge delivery control device a signal instructing that a toner cartridge replacement should be delivered to a user of the image forming device when the image forming device which has emitted the toner near empty signal is such an image forming device that is conditioned by an automatic delivery contract that a toner cartridge replacement is delivered to the user of the image forming device when the toner near empty state is detected according to the condition for controlling the image forming device recorded in the controlling condition table.

(3) Third Medium

A computer-readable recording medium having a program recorded thereon for making a computer comprised in the above mentioned controlling device for the image forming device in the controlling system execute the steps of:

receiving the toner near empty signal from the image forming device to be controlled, referring to the condition for controlling the image forming device recorded in the controlling condition table in the controlling device for the image forming device upon receipt of the toner near empty signal from the image forming device, outputting the toner near empty indication instruction signal instructing that the toner near empty indication should be indicated on the indicating device of the image forming device to the image forming device when the image forming device is an image forming device which should indicate the toner near empty indication on the indicating device according to the controlling condition; and not outputting the toner near empty indication instruction signal to the image forming device when the image forming device is an image forming device which should not indicate the toner near empty indication on the indicating device according to the controlling condition.

This recording medium may further has a program for making the computer comprised in the controlling device execute the steps of outputting to a toner cartridge delivery control device a signal instructing that a toner cartridge replacement should be delivered to a user of the image forming device when the image forming device which has emitted the toner near empty signal is such an image forming device that is conditioned by an automatic delivery contract that a toner cartridge replacement is delivered to the user of the image forming device when the toner near empty state is detected according to the condition for controlling the image forming device recorded in the controlling condition table.

Image forming devices and the like will be described below with reference to drawings.

FIG. 1 shows the outline of the constitution of an example of an image forming device.

An image forming device 400 of FIG. 1 is a multifunctional machine having the functions of a copying machine, a printer, a facsimile machine and other devices. In the image forming device 400 shown in FIG. 1, an image reader IR is mounted on the portion of a printer PR, and a controlling circuit C1 of FIG. 5 described later is also included. The operation of the components of the image forming device described later is carried out by the instructions of the controlling circuit C1 at predetermined timings.

The image reader IR per se is one which is already known, which can read an original image, and provide the read image information for copying the original, facsimile transmission and other purposes.

The printer PR is a tandem type color printer.

The printer PR comprises a paper feeding unit 100 disposed in its lower part, a color image forming unit 200 in its center portion, and further a paper discharging unit 300 thereabove.

The image forming unit 200 has a driving roller 71, a follower roller 72 opposing this and an endless intermediate transfer belt 7 wound on the rollers 71 and 72. The transfer belt 7 is rotated by the driving roller 71 driven by a drive (not illustrated) in the counterclockwise direction CCW in the Fig. (the direction of the arrow in the Fig.).

A cleaning device 73 which cleans toner and other substances on the transfer belt 7 left after secondary transfer of toner image(s) described later opposes a portion of the transfer belt 7 supported by the follower roller 72, and a secondary transfer roller 8 opposes the driving roller 71 with the transfer belt 7 therebetween.

The secondary transfer roller 8 is pressed against a portion of the transfer belt 7 supported on the driving roller 71 by a pressing device (not illustrated), and forms a nipping portion between itself and the transfer belt 7. The secondary transfer roller 8 can be thus rotated following the rotation of the transfer belt 7, or following the movement of a recording paper sheet S transported into the nipping portion as will be described later, or by being driven by a drive (not illustrated).

A secondary transfer bias is applied to the secondary transfer roller 8 from a power source (not illustrated).

Above the intermediate transfer belt 7 and secondary transfer roller 8, a fixing device 9 constituting a part of the paper discharging unit 30 is disposed. Below the belt 7 and roller 8, a timing roller pair 12 and a recording medium conveying roller pair 11 constituting the paper feeding unit 100 and further a recording paper sheet accommodating cassette 10 which accommodates the recording paper sheet(s) (recording paper sheet, recording sheet for an overhead projector, etc.) S are disposed.

In this example, the fixing device 9 comprises, although not limited to, a fixing heating roller 91 heated by a heat source and a pressurizing roller 92 pressed against this. A toner image secondarily transferred on the recording paper sheet passed through the nipping portion between the two rollers 91,92 can be fused and fixed under heat and pressure.

The recording paper sheets S accommodated in the cassette 10 can be withdrawn sheet by sheet by a paper feed roller 101 to be fed to the timing roller pair 12 by the conveying roller pair 11.

The image forming unit 200 comprises four imaging units YH, MH, CH and BH. That is, between the driving roller 71 and follower roller 72 on which the intermediate transfer belt 7 is wound, the imaging unit YH responsible for yellow imaging, imaging unit MH responsible for magenta imaging, imaging unit CH responsible for cyan imaging and imaging unit BH responsible for black imaging are disposed in the order stated from the follower roller 72 to the driving roller 71 along the transfer belt 7.

The imaging units YH, MH, CH, BH each comprises a drum-shaped photosensitive member 1 as an electrostatic latent image support member, a charger 2, a developing device 4 and a cleaning device 5 which are disposed in the order stated around the photosensitive member 1 in the direction of rotation of the member 1.

A primary transfer roller 6 is placed opposing the photosensitive member 1 with the transfer belt 7 therebetween in each of the imaging units. In this example, each of the primary transfer rollers 6 is pressed towards the photosensitive member 1 by a pressing device (not illustrated), comes into contact with the transfer belt 7 to be rotated following the same, and can bring the transfer belt 7 into contact with the photosensitive member 1.

A primary transfer bias for primarily transferring the toner image formed on the photosensitive member 1 onto the belt 7 can be applied to the primary transfer roller 6 from a power source (not illustrated).

On the photosensitive member 1 of each of the imaging units can be formed an electrostatic latent image corresponding to the color associated with each imaging unit by carrying out image exposure from an exposure unit 3. The exposure unit 3 has four laser diodes, polygon mirrors and scanning lenses, among other components, provided thereinside, and depending on an image information provided from the image reader IR, a personal computer (not illustrated), or other components, an image can be exposed on the photosensitive member 1 of each imaging unit.

In FIG. 1, 3*y* is a reflection mirror which reflects the light for forming an electrostatic latent image for yellow from the exposure unit 3 toward the photosensitive member 1 of the imaging unit YH. Likewise, a reflection mirror 3*m* reflects the light for forming an electrostatic latent image for magenta toward the photosensitive member 1 of the unit MH; a reflection mirror 3*c* reflects the light for forming an electrostatic latent image for cyan toward the photosensitive member 1 of the unit CH; and a reflection mirror 3*b* reflects the light for forming an electrostatic latent image for black toward the photosensitive member 1 of the unit BH.

The photosensitive member 1 in each imaging unit is, but is not limited to, a negatively charged photosensitive member in this example, and can be rotationally driven clockwise in the FIG. 1 by a photosensitive member drive motor (not illustrated).

The charger 2 in each imaging unit is a scorotron charger in this example, and a voltage for charging the photosensitive member is applied at predetermined timings from a power source (not illustrated). The charger 2 may be of such a type that uses a charging roller, among other types.

The developing device 4 in each imaging unit may be of such a type that employs a so-called single component developer mainly composed of toner, but in this example, it is of such a type that employs a so-called two-component developer mainly composed of toner and carrier, which is capable of reversal development of the electrostatic latent image on the photosensitive member 1 by a developing roller 41 to which a development bias is applied from a power source (not illustrated).

A yellow toner Yt can be supplied to the developing device 4 of the imaging unit YH from a toner cartridge 15*y* via a sub hopper 16*y*. Similarly, a magenta toner Mt can be supplied to the developing device 4 of the unit MH from a toner cartridge 15*m* via a sub hopper 16*m*; a cyan toner Ct can be supplied to the developing device 4 of the unit CH from a toner cartridge 15*c* via a sub hopper 16*c*; and a black toner Bt can be supplied to the developing device 4 of the unit BH from a toner cartridge 15*b* via a sub hopper 16*b*. Each toner cartridge is exchangeably attached on the printer body. The sub hoppers 16*y* to 16*b* are provided on the corresponding developing deices, respectively. The toner cartridges and sub hoppers will be described later in detail.

The components described above are capable of forming images under the control of a controlling circuit C1 described later in the following manner.

According to the printer PR, an image or images can be formed by using one or more of the imaging units YH, MH, CH and BH of the color image forming unit 200.

Taking, for example, a case in which a full-color image is formed by using all imaging units, first, a yellow toner image is formed in the imaging unit YH responsible for yellow imaging, and this image is primarily transferred onto the transfer belt 7.

That is, in the imaging unit YH, the photosensitive member 1 is rotationally driven clockwise in the FIG. 1; its surface is uniformly charged with a specified potential by the charger 2; the charged area is exposed for forming a yellow image by the exposure unit 3; and a yellow electrostatic latent image is formed on the photosensitive member 1. This electrostatic latent image is developed by the developing roller 41 of the developing device 4 having the yellow toner Yt with a development bias applied to the developing roller 41 to become a visible yellow toner image. The yellow toner image is primarily transferred onto the transfer belt 7 by the primary transfer roller 6. At this time, a primary transfer bias is applied to the primary transfer roller 6 from the power source (not illustrated).

Likewise, a magenta toner image is formed in the imaging unit MH and transferred onto the transfer belt 7, a cyan toner image is formed in the imaging unit CH and transferred onto the transfer belt 7, and a black toner image is formed in the imaging unit BH and transferred onto the transfer belt 7.

The yellow, magenta, cyan and black toner images are formed at the timing when these are transferred onto the intermediate transfer belt 7 on top of each other. A multiple toner image formed on the transfer belt 7 in such a manner is moved toward the secondary transfer roller 8 by the rotation of the transfer belt 7.

Meanwhile, the recording paper sheet S is withdrawn from the cassette 10 by the paper feed roller 101, fed to the timing roller pair 12 past the recording paper sheet conveying roller pair 11, and stands by in that position.

The recording paper S standing by at the timing roller pair 12 as described is fed into the nipping portion between the transfer belt 7 and the secondary transfer roller 8 simultaneously with the transfer of the multiple toner image by the transfer belt 7. The multiple toner image is secondarily transferred onto the recording paper sheet S by the secondary transfer roller 8 to which a secondary transfer bias is applied from the power source (not illustrated).

The recording paper sheet S is passed through the fixing device 9, and the multiple toner image is fixed onto the recording paper S under heat and pressure there. The recording paper sheet S is then discharged into a discharging tray 14 by a discharge roller pair 13.

In the primary transfer of the toner image onto the transfer belt 7, the toner and other matters left and remaining on the photosensitive member 1 are cleaned by the cleaning device 5, and the toner and other matters left and remaining on the transfer belt 7 are cleaned by the cleaning device 73. The toner and other matters cleaned and removed are transported into waste containers by a transporting device (not illustrated).

Figure 2:
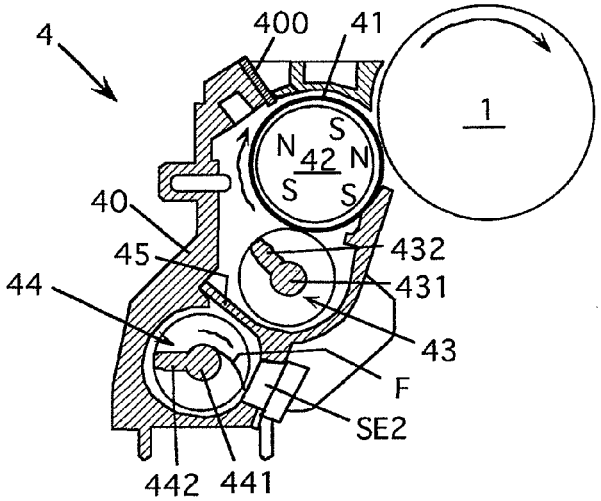
FIG. 2 is a cross-sectional view of a developing device.

The developing device 4 will be further described. The developing device 4 is that shown in FIG. 2. FIG. 2 shows the outline of a cross-sectional structure of the developing device 4.

The developing device 4 has the developing roller 41 in the form of a sleeve and a magnet body 42 approximately in the form of a cylindrical body placed within the developing roller 41.

The developing device 4 further comprises a first stirring conveying member 43 and a second stirring conveying member 44 which uniformly stir toner and carrier in the developer and supply them to the developing roller 41. The first member 43 herein is a screw conveying member comprising a screw blade (spiral blade) 432 attached about a rotation axis 431, and the second component 44 is also a screw conveying member comprising a screw blade (spiral blade) 442 attached about a rotation axis 441.

The developing roller 41 and stirring conveying members 43, 44 are all accommodated in a developing device housing 40, and are rotatably supported on the developing device housing 40. A part of the developing roller 41 is projecting to the outside of the developing device housing 40 so that it opposes the photosensitive member 1 when the developing device 4 is installed in the printer PR. The stirring conveying members 43, 44 are accommodated within the developing device housing 40.

The first stirring conveying member 43 is disposed in parallel with the developing roller 41 in a manner of opposing the developing roller 41, and the second stirring conveying member 44 is disposed in parallel with first stirring conveying member 43 and below the first stirring conveying member 43. A partition 45 is formed between the members 43,44. The partition 45 has opening portions for developer circulation (not illustrated) to the rear and to the front, respectively.

The developer in the developing device housing 40 is stirred and transferred from the rear to the front by the second stirring conveying member 44 driven to rotate by a development motor (not illustrated), transferred and moved to the first stirring and conveying member 43 side from the front opening portion, stirred and conveyed to the rear by the stirring conveying member 43 driven to rotate by the development motor, and is again moved to the second stirring conveying member 44 side from the rear opening portion (not illustrated). Like this, the developer is stirred and circulated, and is supplied to the developing roller 41 in the course of transfer by the first stirring conveying member 43.

The developing roller 41 is also rotationally driven by the development motor (not illustrated), and can retain the brush of the developer (magnetic brush consisting of the developer) on its peripheral surface by the action of the magnet body 42 thereinside, and with the amount of the developer being restricted by a developer regulating member 400 in the course of transfer, can transfer the brush to the development area opposing the photosensitive member 1 to provide it for the development of the electrostatic latent image.

Each of the developing devices 4 comprises at its bottom a toner density detection sensor SE2 which detects the toner density of the developer in the developing device housing 40. This will be further described later.

Next, each of the toner cartridges 15*y* to 15*b* (hereinafter also referred to as "cartridge 15".) which supplies toner to the developing device and each of the sub hoppers 16*y* to 16*b* (hereinafter also referred to as "sub hopper 16".) will be described.

Figure 3:
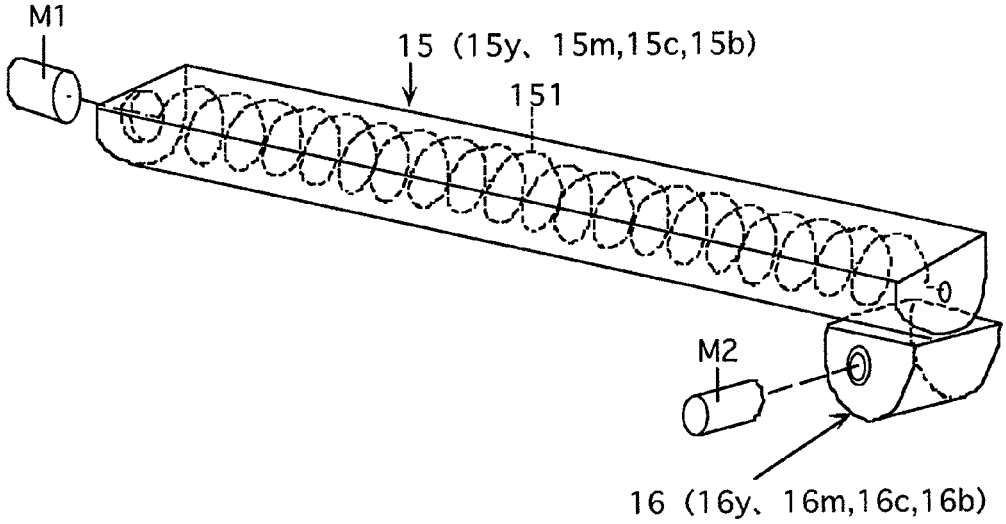
FIG. 3 is a perspective view which shows the outline of a toner cartridge and a sub hopper in a toner replenishing mechanism to the developing device.
Figure 4:
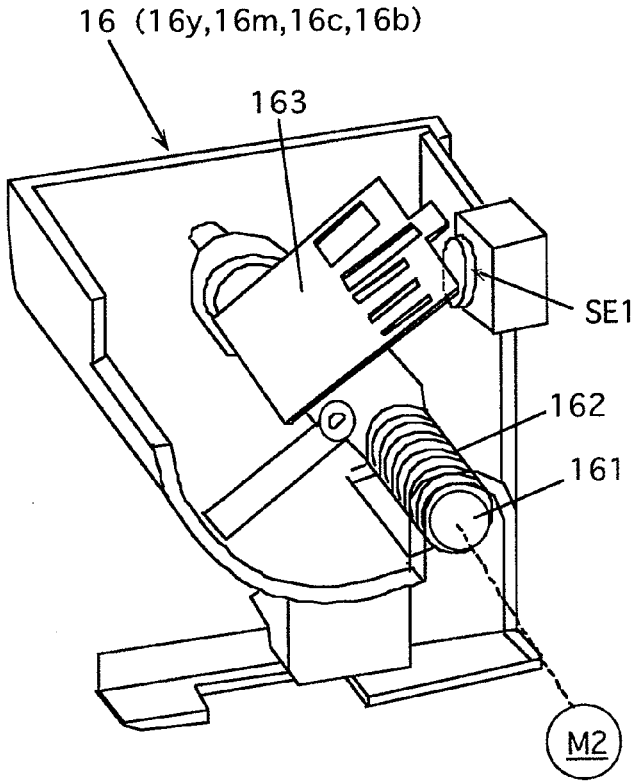
FIG. 4 shows the outline of an internal structure of the sub hopper.

FIGS. 3 and 4 show a mechanism for supplying toner to the developing devices 4. FIG. 3 is a perspective view showing the outline of the toner cartridges 15 and sub hoppers 16. FIG. 4 shows the outline of the internal structure of the sub hoppers 16.

First, toner supply from the toner cartridges 15 to the sub hoppers 16 will be described. As shown in FIG. 2, when the toner cartridge 15 is attached in a predetermined position of the printer PR, a shutter (not illustrated) in an upper part of the sub hopper 16 opens, and the state that toner can be supplied to the sub hopper 16 is attained. A spiral spring (spiral toner transfer spring) 151 is provided in the cartridge 15. This spiral spring 151 is rotationally driven by a motor M1, whereby toner is supplied into the sub hopper 16 from the cartridge 15. The spiral spring 151 is rotationally driven by the motor M1 which is a stepping motor.

Although not illustrated, two stepping motors M1 are used for the total of four spiral springs 151 corresponding to the four colors: yellow, magenta, cyan and black, respectively. A single motor M1 is assigned to the toner cartridges 15*y* and 15*c* via a gear transmission mechanism (not illustrated), and another motor M1 is assigned to the toner cartridges 15*m* and 15*b* via another gear transmission mechanism (not illustrated).

When the two motors M1 are each rotated forwardly, the spiral spring 151 of each of the cartridges 15*y*, 15*c* rotates in the direction that toner is supplied to the sub hopper 16, while the spiral spring 151 of the cartridges 15*m*, 15*b* idles without transferring toner. When the two motors M1 are each reversed, the spiral spring 151 of each of the cartridges 15*m*, 15*b* rotates in the direction that toner is supplied to the sub hopper 16, while the spiral spring 151 of the cartridges 15*y*, 15*c* idles without transferring toner. By switching between the forward and reverse rotation of the stepping motors M1, supply of the yellow toner Yt and cyan toner Ct and that of the magenta toner Mt and black toner Bt are switched.

Next, toner supply from the sub hoppers 16 to the developing devices 4 will be described.

As shown in FIG. 3, a single stepping motor M2 is assigned to each of the four sub hoppers 16*y* to 16*b*. Hereinafter, this motor may be referred to as a sub hopper motor.

By actuating the sub hopper motor M2, a scraping paddle 163 and a spiral roller 162 (a toner feed roller comprising a spiral blade attached to a roller shaft 161) in the sub hopper 16 are rotated, and toner is supplied from the sub hopper 16 to the developing device 4. A toner empty sensor (piezo sensor) SE1 is installed in the sub hopper 16 so that toner is scraped up by the paddle 163, whereby the toner in the sub hopper 16 can be detected.

The toner supplied from the cartridge 15 to the sub hopper 16 is supplied into the developing device 4 by the rotation of the spiral roller 162 by the sub hopper motor M2.

Toner density detection within the developing device 4 will be described with reference to FIG. 2. As already mentioned, each developing device 4 is provided with a toner density detection sensor SE2. A developer (toner and carrier) is accommodated in the developing device 4. A flexible film F provided on the second screw conveying member 44 and rotating therewith is designed to stir the developer around the sensor SE2. The film F is capable of replacing the developer around the sensor SE2 every time the second screw conveying member 44 takes a full rotation (for 1 ripple).

The toner density detection sensor SE2 is a magnetic toner density detection sensor referred to as a TCR sensor, etc., placed at the bottom inside the developing device 4. This sensor reads the magnetic permeability of the amount of iron contained in carrier per unit volume around the sensor. Therefore, the higher the AD converted value (resolution: 10 bit in this example) of the analog signal read by the sensor SE2, the lower the toner density.

Figure 5:
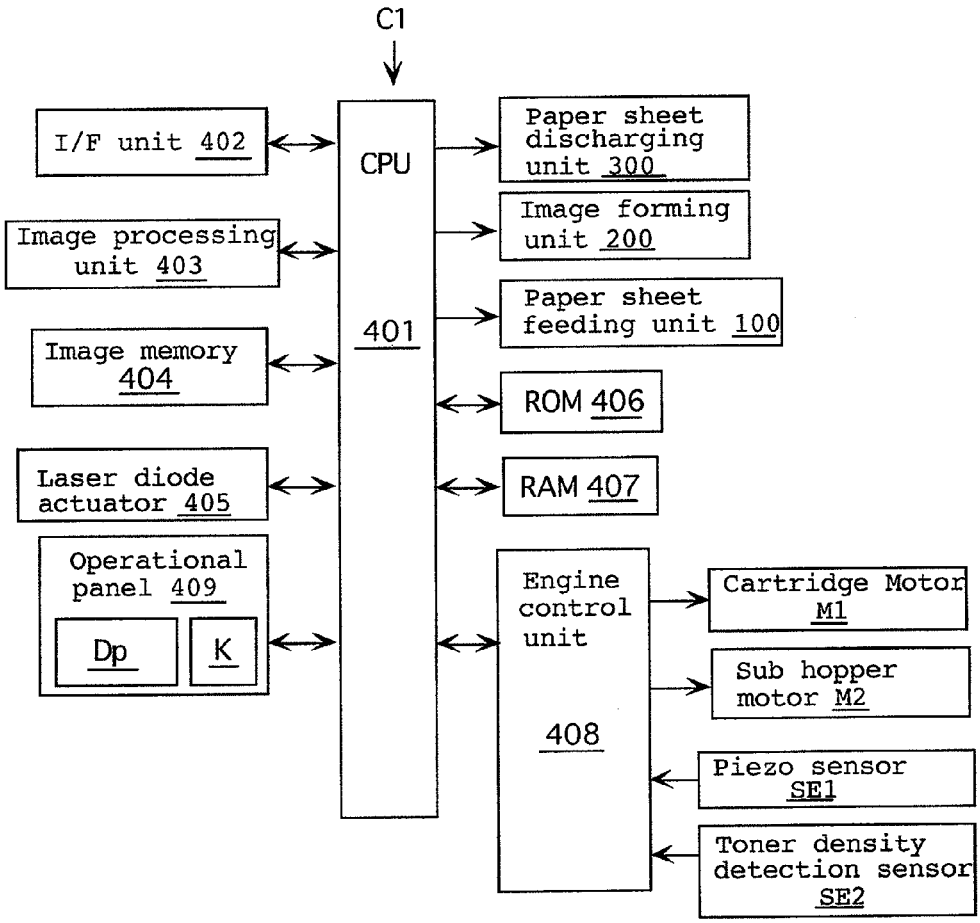
FIG. 5 is a block diagram which schematically shows a controlling circuit of the image forming device of FIG. 1.
Figure 6:
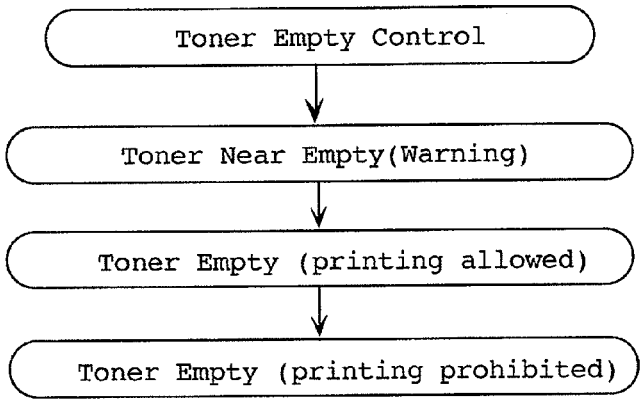
FIG. 6 is a flowchart which shows a toner near empty detection control relating to a developing device and by an engine control unit in the controlling circuit in FIG. 5.

FIG. 6 is a flowchart which shows a toner empty detection control of each developing device 4 by an engine control unit 408 (refer to FIG. 5) in the controlling circuit C1 described later.

As toner is supplied from the toner cartridge 15, the amount of toner remaining in the cartridge is reduced, and toner is emptied (toner empty) at some point. A procedure for detecting the toner empty state will be described below.

As for toner consumption, this image forming device takes into consideration four states: "normal state", "toner near empty", "toner empty (printing allowed)" and "toner empty (printing prohibited)". These states will be described below.

(1) "Normal State":

The normal state that plenty of toner is remaining in the toner cartridge 15, and the amount of the toner remaining should not yet be viewed as a problem.

(2) "Toner Near Empty":

The number of rotation of the motor M1 during rotation of the spiral spring 151 of the cartridge 15 by the motor M1 is totalized; the amount of the toner supplied to the sub hopper 16 is estimated on the basis of the totalized value; and the "toner near empty" state means that the amount of toner remaining in the cartridge determined on the basis of the estimated toner amount supplied to the sub hopper 16 is in the near empty state.

The toner near empty state is for notifying the user of the image forming device that toner will be empty soon and making the user prepare a toner cartridge replacement (i.e., a toner cartridge for replacement). The toner near empty state may be determined to be such an amount of toner remaining that, for example, several thousand pages can be printed before the toner empty state (printing prohibited) is reached, and even when the user has no toner cartridge replacement in stock, a sufficient period can be obtained for preparing a toner cartridge replacement by the time the toner empty state (printing prohibited) is reached after the user orders a toner cartridge replacement, and can be determined appropriately depending on the characteristics of the image forming device, or by performing experiments and other means in some cases.

"Toner near empty" state is calculated in the engine control unit 408.

(3) "Toner Empty (Printing Allowed)":

The toner empty state (printing allowed) is determined to be the time when the empty information detected by the empty detection sensor SE1 in the sub hopper 16 during rotation of the cartridge motor M1 is "empty" for a predetermined consecutive times.

The "toner empty (printing allowed)" state is, for example, the case in which no toner is remaining in the toner cartridge 15, but toner is still remaining in the sub hopper 16 in such an amount that allows for about 100 pages of printing.

(4) "Toner Empty (Printing Prohibited)":

This is the state that a predetermined number of pages (the number which estimatedly empties the toner in the sub hopper 16 from experiments, experiences, etc.,) have been printed from the toner empty state (printing allowed), and there is no more toner in the sub hopper. Printing is prohibited at this time.

A CPU (center processing unit) 401 which exchanges information with the engine control unit 408, in the case of the "toner near empty" state and the "toner empty state (printing allowed)", can indicate the warning to the effect that "toner will be empty soon" in part of a display Dp of an operational panel 409. In addition, in the case of the "toner empty state (printing prohibited)", a warning to the effect that the toner is empty is indicated on the entire display Dp.

The operational panel 409 comprises a key group K including, for example, numeric keys for setting the number of pages of image formation, keys for selecting the size of the recording paper sheet, among others. In addition to the above-mentioned indication, the display Dp can indicate various information.

The states are summarized in the table below.

TABLE 1

| Toner empty state | Printing allowed state | Panel indication | Meaning |
|---|---|---|---|
| Normal | Allowed | No indication | The state that plenty of toner is present in toner cartridge and sub hopper |
| Toner near empty | Allowed | One-line message: "Toner cartridge will need to be replaced soon" | The state that toner is present in sub hopper, but is low in toner cartridge |
| Toner empty (printing allowed) | Allowed | One-line message: "Toner empty. Replace toner cartridge." | State that toner is present in sub hopper, but not in toner cartridge |
| Toner empty (printing prohibited) | Prohibited | Entire screen warning: "Toner empty. Replace toner cartridge and close toner supply door" | State that no toner is present in sub hopper and toner cartridge and no more printing is possible due to low toner density |

As shown in the table above, it does not matter if the toner cartridge is replaced when the state is "toner empty (printing allowed)" or thereafter since the toner cartridge 15 is empty, but replacing the cartridge in the "toner near empty" state is not desirable since some toner is remaining therein.

Figure 7:
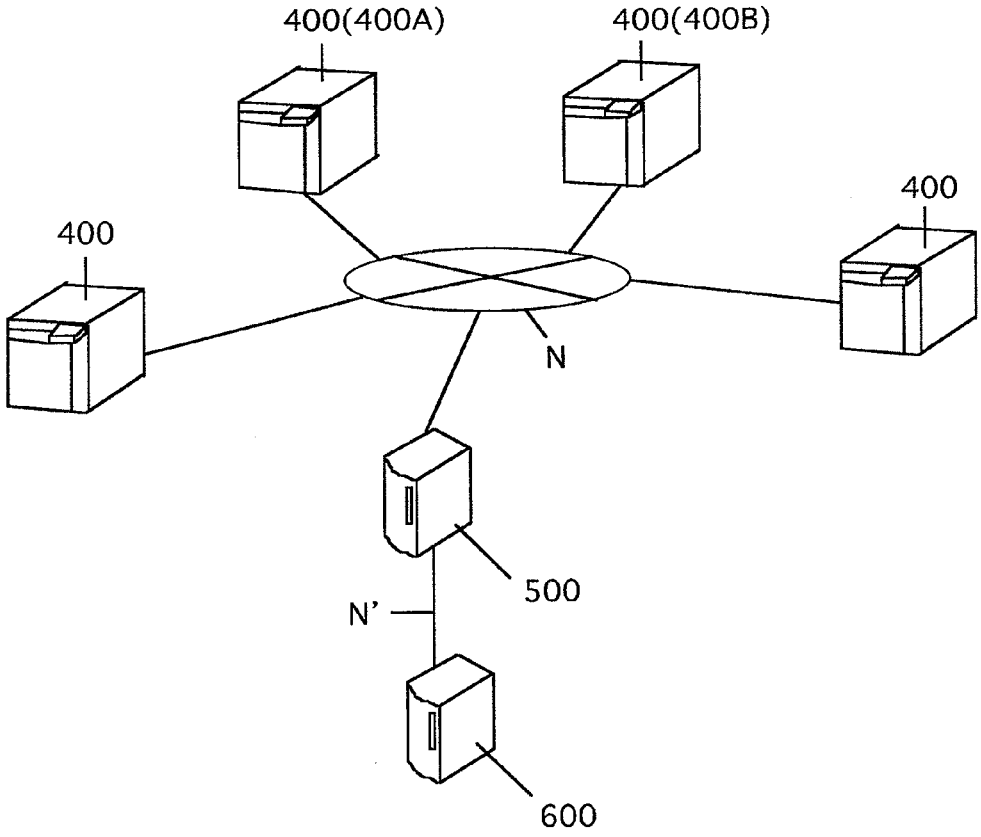
FIG. 7 shows a system for controlling the image forming devices.

FIG. 7 shows an example of the system for controlling an image forming device.

The controlling system of FIG. 7 comprises a plurality of image forming devices which are made capable of two-way communication with a controlling device (administrative server computer) 500 via a communication network N.

The controlling device 500 is usually placed at service bases and like sites of the image forming devices, and manages the information of a plurality of the image forming devices placed at different locations of users. As functions of the system, the controlling device 500 is capable of obtaining charging information such as the number of printed pages and information on trouble status from the image forming devices, and performing charging management and maintenance management.

Generally speaking, the image forming devices placed at locations of users and connected to the controlling device 500 may be different in type. For example, they may be printers and/or copying machines. Such image forming machines may be color image forming machines and/or monochrome image forming machines, or other type of machines depending on the cases.

Since the controlling device 500 can grasp forms and states of use of the image forming device at the user's end, it can store the settings of controlling conditions and other information for each image forming device in a storage device and remotely manage each image forming device for optimal operation. Since this setting of each image forming device can be concentratedly controlled by the controlling device 500, changes in the settings about the operation of an image forming device at a remote location can be also easily made at the server side. Exchange of information between each image forming device and the controlling device 500 is carried out, for example, by electronic mail communication via the internet.

The controlling device 500 is also connected to a toner delivery control device (toner delivery management computer) 600 constituting a toner ordering system via a communication network N', and therefore it can also conduct so-called automatic delivery by giving an order for a toner cartridge replacement to the delivery control device 600 based on the toner near empty information from the image forming device and sending it to the user.

In this example, the communication networks N, N' utilize the internet.

Figure 8:
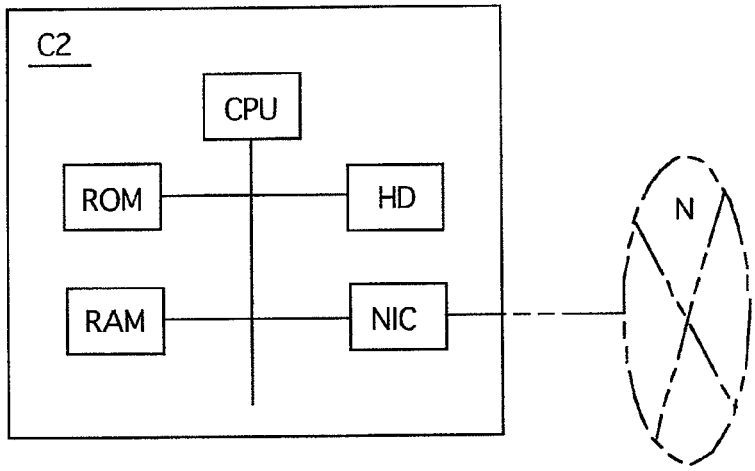
FIG. 8 shows the outline of a circuit configuration of a controlling device in the controlling system of FIG. 7.

FIG. 8 is a block diagram which shows the basic constitution of a circuit C2 of the controlling device 500.

The controlling device (administrative server) 500 has a central processing unit CPU which controls the components in the administrative server 500 according to the basic software, i.e., the operating system (OS) and like programs, and a read-only memory ROM which stores a boot program executed on startup of the administrative server 500, a random access memory RAM which is utilized as a buffer area of the work area necessary for executing programs, and a network interface card NIC for transmitting and receiving various data between a hard disk HD which contains the OS, application programs and various data and external devices. These constitutions are connected to each other via a bus to enable data transmission and receipt.

In addition, a controlling condition table in which controlling conditions set for each image forming device 400 are recorded is stored in the hard disk HD.

The hard disk HD also contains a program for executing the steps of:

receiving a toner near empty signal from the image forming device 400 to be controlled, and referring to the condition for controlling the image forming device recorded in the controlling condition table for the image forming device upon receiving the toner near empty signal from the image forming device 400, outputting an indication instruction signal to the image forming device instructing that a toner near empty indication should be indicated on the display Dp of the operational panel 409 when the image forming device is an image forming device which should indicate the toner near empty indication according to the controlling conditions, and not outputting the indication instruction signal to the image forming device when the image forming device is an image forming device which should not indicate the toner near empty indication on the display Dp according to the controlling conditions.

The hard disk HD further contains a program for executing the step of outputting a delivery instruction signal that a toner cartridge replacement should be delivered to the user of the image forming device to the toner cartridge delivery control device 600 when the image forming device which has emitted the toner near empty signal is an image forming device which should not indicate the toner near empty indication on the display Dp according to the controlling conditions recorded in the controlling condition table.

FIG. 5 is a block diagram which shows the controlling circuit C1 of the image forming device 400. This controlling circuit C1 comprises as main components a central processing unit (CPU) 401, a communication interface I/F unit 402, an image processing unit 403, an image memory 404, an actuator 405 of the exposure unit 3 (in particular, its laser diode), a ROM 406, a RAM 407, and an engine control unit 408, among others.

The communication I/F unit 402 is an interface for connecting to a LAN, such as a LAN card, a LAN board, which receives data of a printing job from outside and transfers the received data to the image processing unit 403.

The image processing unit 403 converts the data of the printing job from the communication I/F unit 402 into image data of reproduced colors: yellow Y, magenta M, cyan C and black B (hereinafter also referred to simply as Y, M, C and B.), outputs the data to the image memory 404, and stores these image data for each reproduced color in the image memory 404.

The laser diode actuator 405 reads the image data of each color from the image memory 404, and starts the laser diodes of the exposure unit 3.

The ROM 406 contains, in addition to control programs relating to image formation operation, data used for toner supply control and toner empty detection control, and further tables and other information used for controlling.

In addition, the ROM 406 contains a program for executing the steps of:

transmitting the toner near empty signal to the controlling device 500 when it is detected (calculated) that the amount of toner in the toner cartridge 15 is in the toner near empty state in the engine control unit 408, indicating the toner near empty indication on the display Dp of the operational panel 409 upon receiving the toner near empty indication instruction signal from the controlling device 500, and not indicating the toner near empty indication on the display Dp when it does not receive the toner near empty indication instruction signal from the controlling device 500 (when it receives the toner near empty non-indication instruction) although the toner near empty signal has been transmitted.

The RAM 407 is used as a work area of the CPU 402.

The CPU 401 reads necessary programs from the ROM 406, and executes conversion processes of image data in the image processing unit 403 and writes/reads image data in the image memory 404, among other operations.

The CPU 401 also synchronously controls the operations of a color image forming unit 200, the paper feeding unit 100 and other components to execute smooth printing operation. It further indicates a predetermined message indication about the time to replace the toner cartridge 15 on the operational panel 409 based on the toner empty information input from the engine control unit 408.

The communication I/F unit 402 can further transmit the toner empty information, warnings, trouble and various other information about printing, and receive data and commands from the controlling device 500 via the communication network.

Typical examples of warning indications about the toner empty state on the display Dp of the operational panel 409 of the image forming device 400 include those described in the column of panel display in Table 1 above. In any case, the warnings are indicated as messages. The indication for the toner empty state (printing prohibited) may be "Toner empty. Replace toner cartridge" state.

Figure 9:
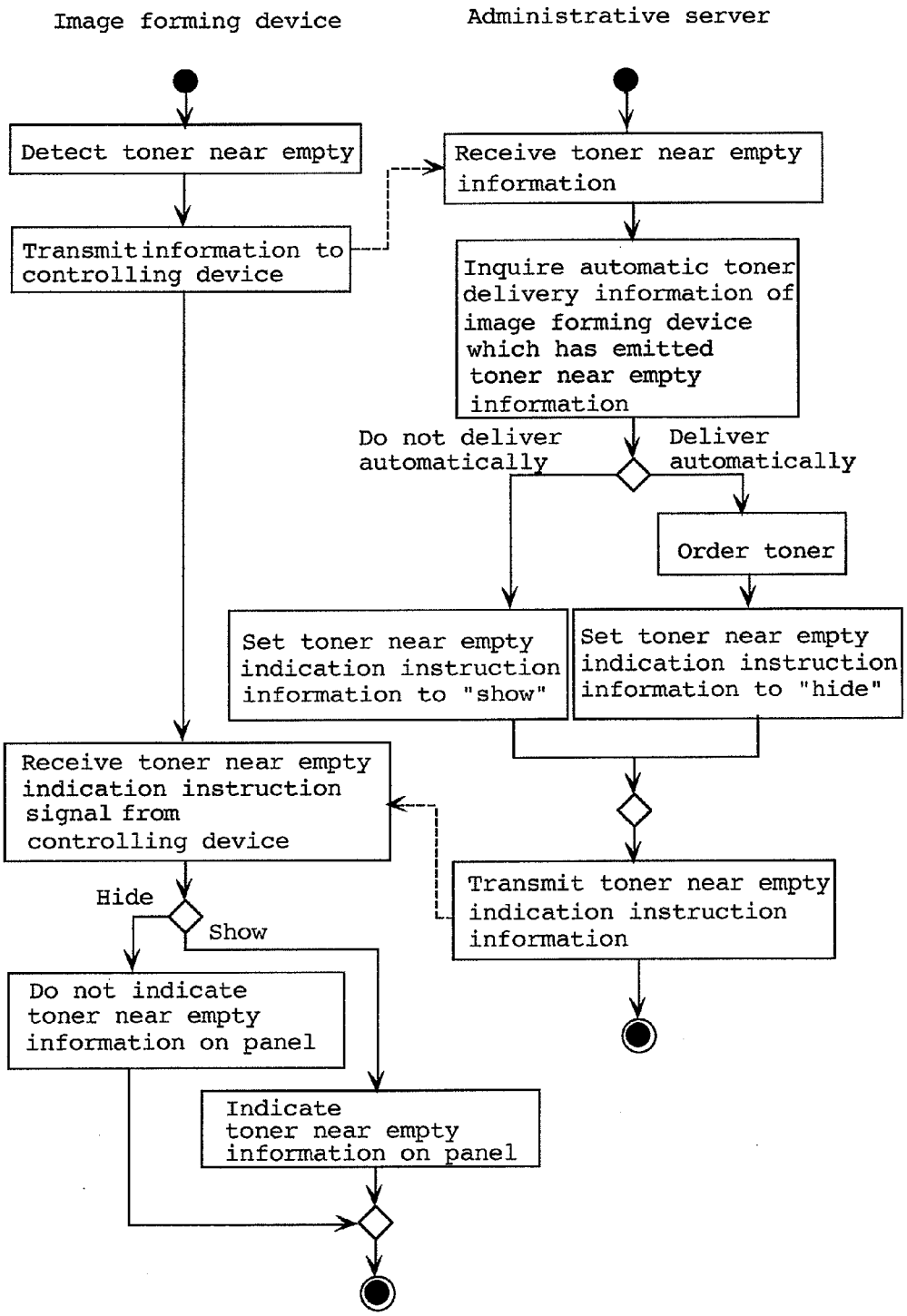
FIG. 9 is a flowchart which shows display control and the like relating to the toner near empty detection in each of the image forming device and an administrative server constituting the controlling system in FIG. 7.

FIG. 9 is a flowchart which shows an example of display control according to the toner near empty detection in each of the image forming devices 400 in the controlling system including the image forming devices 400 and the administrative server 500 shown in FIG. 7.

The controlling device (administrative server) 500 stores the controlling condition table in which controlling conditions set for each image forming device 400 to be controlled are recorded. In the example shown in FIG. 9, whether or not to indicate the toner near empty indication on the panel 409 is switched according to the conditions of automatic delivery of the toner cartridge shown by the controlling condition table stored in the controlling device 500.

First, the case where the toner cartridges are automatically delivered will be described.

When the toner near empty state occurs in a certain image forming device 400 (400A), firstly, the information that the toner near empty state has occurred is notified to the controlling device 500 connected via the communication network N. As described above, the toner near empty state is determined to be the time when the number of rotation of the cartridge motor M1 is totalized during its rotation; the amount of toner supplied from the cartridge 15 to the sub hopper 16 is estimated; and the amount of toner remaining in the toner cartridge 15 is in the near empty range. The information generated by the toner near empty state includes the characteristic data of the image forming device, the information of the color of the empty cartridge, the model number of the cartridge and other information.

At this time, the information that the toner near empty state has occurred is not indicated on the display Dp of the operational panel 409 of the image forming device 400A.

Next, the controlling device 500 which has received the toner near empty information queries the above-mentioned control information table stored in the storage device in the controlling device for the controlling condition information of the image forming device 400A notified.

Herein, the presence or absence of the conditions for toner cartridge automatic delivery is queried. The conditions for automatic delivery of the toner cartridge vary depending on the user's contract. For example, in case of a user charged on a pay-per-page basis, the price of the toner is included in the contract charge, and therefore the automatic delivery is not disadvantageous to the user. However, a user charged on a spot basis purchases toner for printing, and therefore delivery without his/her consent is not allowed. In addition, even in the case of users who are charged per page, some may wish to have confirmation of delivery in advance.

The conditions for the automatic delivery for each of the image forming devices 400 can be changed on the controlling device 500 side, and by changing the conditions, the panel indication (indication by the display Dp of the operational panel 409) in the near empty state and automatic order placement are changed.

Since the image forming device 400A which has notified of the toner empty information is conditioned to automatically deliver toner cartridges, the controlling device 500 orders toner of an applicable model number and color with the toner delivery controlling device 600 of the toner ordering system, and instructs not to indicate the toner near empty indication on the panel 409 to the image forming device 400A through communication. The image forming device 400A which has received the instruction not to indicate the indication from the controlling device 500 does not indicate the toner near empty indication on the panel.

Next, the case where automatic delivery of the toner cartridge is not conducted will be described. When the toner near empty state occurs in an image forming device 400 (400B) different from the image forming device 400A, firstly, the information that the toner near empty state has occurred is notified to the controlling device 500 connected via the communication network N.

At this time, the information that the toner near empty state has occurred is not indicated on the panel 409 of the device 400B. Notification is made, for example, through electronic mails. Next, the controlling device 500 which has received the toner near empty information inquires the controlling condition table stored in the storage device in the controlling device for the information on the controlling conditions of the image forming device 400B which has sent out the information.

In this example, the image forming device 400B which has notified of the toner empty information is not conditioned to automatically deliver a toner cartridge, and therefore the controlling device 500 instructs the device 400B to indicate the toner near empty indication on the panel by communication. The device 400B which has received the instruction from the controlling device 500 indicates a message showing that the toner is near empty on the display Dp. Accordingly, the user learns that the toner will be empty soon, and can therefore order a toner cartridge replacement if necessary.

Switching between showing and hiding the toner near empty indication of the image forming device to be controlled which is controlled on the controlling device 500 side is carried out not only by the presence or absence of conditions for automatic delivery of the toner cartridge described above, but possibly also by the following conditions. Since the flowcharts of the control of showing/hiding indication on the image forming device side and the controlling device side are similar to those shown in FIG. 9 except for the controlling conditions to refer to, illustration of control of showing/hiding indication by the flowcharts is omitted.

<In Case of Switching Between Showing/Hiding Depending on Manual Setting>

One example is switching between showing/hiding indication depending on manual settings.

That is, showing/hiding of the toner status is switched for each image forming device 400 to be controlled depending on the manual settings in the controlling device 500. For example, the toner near empty indication need not be indicated on the image forming device 400 placed in the circumstances of the user who can always keep the toner cartridge replacement 15 in stock.

Since such conditions vary depending on the office environment of the user, the situation of the user and other conditions, switching between showing/hiding is facilitated by allowing the setting of showing/hiding indication on each image forming device placed at the user's location to be held as data in the controlling device 500 and by allowing the setting data to be held on the controlling device 500 side. On the contrary, if the setting data of showing/hiding is held on the image forming device, a serviceperson needs to go to the site of the image forming device to make a change, and thus changes are difficult to make. In addition, by allowing the setting data to be held on the controlling device 500 side, for example, even an image forming device having no storage device and therefore no ability to store any data can operate to show/hide indication.

<In Case where Showing/Hiding is Switched Depending on the Billing Setting>

An example in which showing/hiding is switched depending on the billing setting can be also shown.

For example, in case of a user charged on a spot basis, the toner near empty indication is indicated since toner is purchased by the user. By indicating the indication earlier, the grace period for the purchase can be prolonged.

In case of a user charged on an as-used basis, a contract has been made for a certain price per page of print, and it is often the case that toner cartridge replacements are always kept in stock at the user's location. In this case, the toner near empty indication need not be indicated.

<In Case of Switching Between Showing/Hiding Indication Depending on the Type of the Image Forming Device to be Controlled>

For example, showing/hiding indication is switched depending on the type of the image forming device which is being controlled.

Some devices have such a constitution that the level of toner remaining in the toner cartridge 15 is low when the toner near empty state is detected. In such type of device, no problem is caused if the toner near empty indication is indicated on the panel.

The information on the conditions whether or not to indicate the toner near empty indication is not held on the image forming device side, but may be set for each type of the image forming device on the controlling device side. The controlling device 500 can query the controlling condition table stored in the storage device of the controlling device 500 whether or not to show the toner near empty indication on the basis of the device type of the image forming device which has emitted the information that the toner near empty state occurred, and can switch between instructions to show/hide indication based on the set data.

By allowing the showing/hiding information to be held not by the image forming device but by the controlling device side, the constitution for controlling can be common on the side of various image forming devices. In addition, even when changes occur, they can be collectively made on the controlling device side so that the flexibility of operation can be increased.

<Example of Switching Between Showing/Hiding Indication According to History of Timing to Replace the Toner Cartridge>

For example, switching between showing and hiding and switching the indication timing can be also changed according to the history of the timing to replace the toner cartridge.

In this case, after the toner near empty information is transmitted from the image forming device 400 to the controlling device 500, the toner empty (printing allowed) and toner empty (printing prohibited) information is also transmitted to the controlling device 500.

In addition, when the user replaces the toner cartridge 15, it is learned that the toner cartridge has been replaced with a new one based on new information recorded in a memory attached to the toner cartridge and/or new information provided by a fuse which is blown when a new toner cartridge is installed and a voltage is applied to the toner cartridge. Therefore, replacement information can be transmitted to the controlling device 500 at the timing when the toner cartridge is replaced.

That is, it can be known that the toner cartridge has been replaced during a period from the toner near empty state to the toner empty (printing allowed) state. The fact that the toner cartridge is replaced during this while likely means that the replaced toner cartridge has been kept in stock by the user. The history of the timing of replacing the toner cartridge in the image forming device to be controlled can be stocked in the controlling device 500, and showing/hiding indication can be switched depending on the information. For example, when the history shows many cases of toner cartridges replaced immediately after the occurrence of the toner near empty state, toner is often prematurely wasted. Therefore, the toner near empty indication is discontinued from the perspective of saving toner.

The image forming device described above is a full color image forming device of tandem type, but the present invention can be also applied to color image forming devices of the so-called four cycle type and other types, and can be also applied to monochrome image forming devices.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A system for controlling an image forming device comprising the image forming device and a controlling device that manages a plurality of image forming devices, the image forming device being capable of forming an electrostatic latent image on an image support; being capable of developing the electrostatic latent image with a developing device having a developer therein to form a toner image and being capable of supplying a toner from a replaceably attached toner cartridge to the developing device, and comprising a toner level detecting device for detecting a level of toner in the toner cartridge, the toner level detecting device being capable of detecting a toner near empty state indicating that the toner cartridge will be shortly empty of toner, and having an indicating device which can indicate that the toner cartridge is in the toner near empty state and a communication part for communicating with the controlling device via a communication network, the communication part outputting a toner near empty signal to the controlling device when the toner level detecting device detects the toner near empty state, the indicating device indicating a toner near empty indication when the communication part receives a toner near empty indication instruction signal which instructs that the toner near empty indication should be indicated on the indicating device from the controlling device which has received the toner near empty signal, the indicating device not indicating the toner near empty indication when the communication part does not receive the toner near empty indication instruction signal although the toner near empty signal is output to the controlling device, the controlling device having a controlling condition table recording a controlling condition set for each image forming device to be controlled and a communication part for communicating with the image forming device to be controlled via the communication network, the controlling device referring to the controlling condition for controlling the image forming device recorded in the controlling condition table for the image forming device when the communication part receives the toner near empty signal from the image forming device to be controlled, outputting the toner near empty indication instruction signal for instructing that the toner near empty indication should be indicated on the indicating device to the image forming device when the image forming device is an image forming device which should indicate the toner near empty indication on the indicating device according to the controlling condition, and not outputting the indication instruction signal to the image forming device when the image forming device is an image forming device which should not indicate the toner near empty indication on the indicating device according to the controlling condition.

2. The system for controlling an image forming device according to claim 1, wherein the controlling condition for determining whether or not to output the toner near empty indication instruction signal recorded in the controlling condition table in the controlling device for each image forming device to be controlled is at least one selected from the following conditions:

(1) condition that an automatic delivery contract to deliver a toner cartridge replacement to a user of the image forming device when the toner near empty state is detected in the image forming device is made (condition (1)), (2) condition that even when the toner near empty signal is received, the image forming device which has emitted the signal is placed under circumstances where a toner cartridge replacement is always kept in stock (condition 2);

(3) condition that even when the toner near empty signal is received, a billing contract on a pay-per-page of image formation basis is made for the image forming device which has emitted the signal (condition 3);

(4) condition that when the toner near empty state is detected in the image forming device which has emitted the toner near empty signal, only a predetermined low amount of toner is left in the toner cartridge (condition 4); and (5) condition that it can be assumed that the toner cartridge will be replaced shortly after the toner near empty state is detected according to history of toner cartridge replacement relating to the image forming device which has emitted the toner near empty signal (condition 5), and the controlling device is so arranged that the toner near empty indication instruction signal is not output to the image forming device for which at least one of the conditions (1), (2), (3) and (5) is set even when the toner near empty signal is transmitted from the image forming device, and the toner near empty indication instruction signal is output to the image forming device for which the condition (4) is set when the toner near empty signal is transmitted from the image forming device.

3. The system for controlling an image forming device according to claim 2, wherein the controlling system further comprises a toner cartridge delivery control device having a communication part for communicating with the controlling device through a communication network, the controlling device has a delivery instruction communication part for communicating with the toner cartridge delivery control device through the communication network, and as for the image forming device which transmits the toner near empty signal, if the condition for controlling the image forming device recorded in the controlling condition table includes the condition (1), the controlling device does not output the toner near empty indication instruction signal to the image forming device, but outputs a delivery instruction signal to the toner cartridge delivery control device for instructing the toner cartridge delivery control device to deliver the toner cartridge replacement to the user of the image forming device.

4. A controlling device that manages a plurality of image forming devices and each image forming device being capable of forming an electrostatic latent image on an image carrier; being capable of developing the electrostatic latent image by a developing device having a developer therein to form a toner image and being capable of supplying a toner from a replaceably attached toner cartridge to the developing device, and comprising a toner level detecting device for detecting a level of toner in the toner cartridge, the toner level detecting device being capable of detecting a toner near empty state indicating that the toner cartridge will be shortly empty of toner, and having an indicating device which can indicate that the toner cartridge is in the near empty state and a communication part for communicating with the controlling device for the image forming device via a communication network, the communication part outputting a toner near empty signal to the controlling device when the toner level detecting device detects the toner near empty state, the indicating device indicating a toner near empty indication when the communication part receives a toner near empty indication instruction signal which instructs that the toner near empty indication should be indicated on the indicating device from the controlling device which has received the toner near empty signal, the indicating device not indicating the toner near empty indication when the communication part does not receive the toner near empty indication instruction signal although the toner near empty signal is output to the controlling device, the controlling device having a controlling condition table recording a controlling condition set for each image forming device to be controlled and a communication part for communicating with the image forming device to be controlled via the communication network, the controlling device referring to the controlling condition for controlling the image forming device recorded in the controlling condition table for the image forming device when the communication part receives the toner near empty signal from the image forming device to be controlled, outputting the toner near empty indication instruction signal for instructing that the toner near empty indication should be indicated on the indicating device to the image forming device when the image forming device is an image forming device which should indicate the toner near empty indication on the indicating device according to the controlling condition, and not outputting the indication instruction signal to the image forming device when the image forming device is an image forming device which should not indicate the toner near empty indication on the indicating device according to the controlling condition.

5. The controlling device for an image forming device according to claim 4, wherein the controlling condition for determining whether or not to output the toner near empty indication instruction signal recorded in the controlling condition table in the controlling device for each image forming device to be controlled is at least one selected from the following conditions:

(1) condition that an automatic delivery contract to deliver a toner cartridge replacement to a user of the image forming device when the toner near empty state is detected in the image forming device is made (condition (1));

(2) condition that even when the toner near empty signal is received, the image forming device which has emitted the signal is placed under circumstances where the toner cartridge replacement is always kept in stock (condition 2);

(3) condition that even when the toner near empty signal is received, a billing contract on a pay-per-page of image formation basis is made for the image forming device which has emitted the signal (condition 3);

(4) condition that when the toner near empty state is detected in the image forming device which has emitted the toner near empty signal, only a predetermined low amount of toner is left in the toner cartridge (condition 4); and (5) condition that it can be assumed that the toner cartridge will be replaced shortly after the toner near empty state is detected according to history of toner cartridge replacement relating to the image forming device which has emitted the toner near empty signal (condition 5), and the controlling device so arranged that the toner near empty indication instruction signal is not output to the image forming device for which at least one of the conditions (1), (2), (3) and (5) is set even when the toner near empty signal is transmitted from the image forming device, and the toner near empty indication instruction signal is output to the image forming device for which the condition (4) is set when the toner near empty signal is transmitted from the image forming device.

6. The controlling device according to claim 5, wherein the controlling device has a delivery instruction communication part for communicating with a toner cartridge delivery control device through a communication network, and as for the image forming device which transmits the toner near empty signal, if the condition for controlling the image forming device recorded in the controlling condition table includes the condition (1), the controlling device does not output the toner near empty indication instruction signal to the image forming device, but outputs a delivery instruction signal to the toner cartridge delivery control device for instructing the toner cartridge delivery control device to deliver the toner cartridge replacement to the user of the image forming device.

7. An image forming device being capable of forming an electrostatic latent image on an image support; being capable of forming a toner image by developing the electrostatic latent image with a developing device having a developer therein and being capable of supplying a toner from a replaceably attached toner cartridge to the developing device, and comprising a toner level detecting device for detecting a level of toner in the toner cartridge, the toner level detecting device being capable of detecting a toner near empty state indicating that the toner cartridge will be shortly empty of toner, the image forming device having an indicating device which can indicate that the toner cartridge is in the near empty state and a communication part for communicating with a controlling device that manages a plurality of image forming devices via a communication network, the image forming device being so arranged that when the toner level detecting device detects the toner near empty state, a toner near empty signal is output from the communication part to the controlling device; when the communication part receives a toner near empty indication instruction signal instructing that a toner near empty indication should be indicated on the indicating device from the controlling device which has received the toner near empty signal, the indicating device indicates the toner near empty indication; and when the communication part does not receive the toner near empty indication instruction signal although the toner near empty signal is output to the controlling device, the indicating device does not indicate the toner near empty indication.

8. A non-transitory computer-readable recording medium having a program recorded thereon for making a computer comprised in a controlling device that manages a plurality of image forming devices, and each image forming device being capable of forming a toner image in a system for controlling the image forming device execute the steps of:

receiving a toner near empty signal from the image forming device to be controlled, referring to a condition for controlling the image forming device recorded in a controlling condition table in the controlling device for the image forming device upon receipt of the toner near empty signal from the image forming device, outputting a toner near empty indication instruction signal instructing that a toner near empty indication should be indicated on a indicating device of the image forming device to the image forming device when the image forming device is an image forming device which should indicate the toner near empty indication on the indicating device according to the controlling condition; and not outputting the toner near empty indication instruction signal to the image forming device when the image forming device is an image forming device which should not indicate the toner near empty indication on the indicating device according to the controlling condition although the toner near empty signal was received by the controlling device from the image forming device.

9. The non-transitory computer-readable recording medium according to claim 8, wherein the medium further has a program recorded thereon for making the computer comprised in the controlling device execute the step of outputting to a toner cartridge delivery control device a signal instructing that a toner cartridge replacement should be delivered to a user of the image forming device when the image forming device which has emitted the toner near empty signal is such an image forming device that is conditioned by an automatic delivery contract that the toner cartridge replacement is delivered to the user of the image forming device when the toner near empty state is detected according to the condition for controlling the image forming device recorded in the controlling condition table.

10. A non-transitory computer-readable recording medium having a program recorded thereon for making a computer comprised in a controlling device that manages a plurality of image forming devices, and each image forming device being capable of forming a toner image execute the steps of:

receiving a toner near empty signal from the image forming device to be controlled, referring to a condition for controlling the image forming device recorded in a controlling condition table in the controlling device for the image forming device upon receipt of the toner near empty signal from the image forming device, outputting a toner near empty indication instruction signal instructing that a toner near empty indication should be indicated on a indicating device of the image forming device to the image forming device when the image forming device is an image forming device which should indicate the toner near empty indication on the indicating device according to the controlling condition; and not outputting the toner near empty indication instruction signal to the image forming device when the image forming device is an image forming device which should not indicate the toner near empty indication on the indicating device according to the controlling condition although the toner near empty signal was received by the controlling device from the image forming device.

11. The non-transitory computer-readable recording medium according to claim 10, wherein the medium further has a program recorded thereon for making the computer in the controlling device execute the step of outputting to a toner cartridge delivery control device a signal instructing that a toner cartridge replacement should be delivered to a user of the image forming device when the image forming device which has emitted the toner near empty signal is such an image forming device that is conditioned by an automatic delivery contract that the toner cartridge replacement is delivered to the user of the image forming device when the toner near empty state is detected according to the condition for controlling the image forming device recorded in the controlling condition table.

12. A non-transitory computer-readable recording medium having a program recorded thereon for making a computer comprised in an image forming device being capable of forming a toner image execute the steps of transmitting a toner near empty signal to a controlling device that manages a plurality of image forming devices when a toner level detecting device included in the image forming device detects that a toner cartridge for supplying toner is in a toner near empty state, indicating a toner near empty indication on a indicating device of the image forming device upon receiving a toner near empty indication instruction signal from the controlling device, and not indicating the toner near empty indication on the indicating device when the toner near empty indication instruction signal is not received from the controlling device although the toner near empty signal was transmitted to the controlling device.

13. A system for controlling an image forming device comprising:

the image forming device;

a controlling device for the image forming device; and a toner cartridge delivery control device, wherein the image forming device being capable of forming an electrostatic latent image on an image support, being capable of developing the electrostatic latent image with a developing device having a developer therein to form a toner image and being capable of supplying a toner from a replaceably attached toner cartridge to the developing device, and comprising a toner level detecting device for detecting a level of toner in the toner cartridge, the toner level detecting device being capable of detecting a toner near empty state indicating that the toner cartridge will be shortly empty of toner, and having an indicating device which can indicate that the toner cartridge is in the toner near empty state and a communication part for communicating with the controlling device via a communication network, the communication part outputting a toner near empty signal to the controlling device when the toner level detecting device detects the toner near empty state, the indicating device indicating a toner near empty indication when the communication part receives a toner near empty indication instruction signal which instructs that the toner near empty indication should be indicated on the indicating device from the controlling device which has received the toner near empty signal, and the indicating device not indicating the toner near empty indication when the communication part does not receive the toner near empty indication instruction signal although the toner near empty signal is output to the controlling device, the controlling device having a controlling condition table recording a controlling condition set for each image forming device to be controlled, the controlling condition being a condition that an automatic delivery contract to deliver a toner cartridge replacement to a user of the image forming device when the toner near empty state is detected in the image forming device is made, or the automatic delivery contract is not made, and a communication part for communicating with the image forming device to be controlled via the communication network, the controlling device refers to the controlling condition for controlling the image forming device recorded in the controlling condition table for the image forming device when the communication part receives the toner near empty signal from the image forming device to be controlled, and as for the image forming device which transmits the toner near empty signal, if the condition for controlling the image forming device recorded in the controlling condition table includes the condition that the automatic delivery contract is made, and not outputting the toner near empty indication instruction signal to the image forming device, but outputting a delivery instruction signal to the toner cartridge delivery control device for instructing the toner cartridge delivery control device to deliver the toner cartridge replacement to the user of the image forming device, and in a case where the condition for controlling the image forming device recorded in the controlling condition table does not include the condition that the automatic delivery contract is made, outputting the toner near empty indication instruction signal to the image forming device.

14. A controlling device for an image forming device being capable of forming an electrostatic latent image on an image carrier, being capable of developing the electrostatic latent image by a developing device having a developer therein to form a toner image and being capable of supplying a toner from a replaceably attached toner cartridge to the developing device, and comprising:

a toner level detecting device for detecting a level of toner in the toner cartridge, wherein the toner level detecting device being capable of detecting a toner near empty state indicating that the toner cartridge will be shortly empty of toner, and having an indicating device which can indicate that the toner cartridge is in the near empty state and a communication part for communicating with the controlling device for the image forming device via a communication network, wherein the communication part outputting a toner near empty signal to the controlling device when the toner level detecting device detects the toner near empty state, the indicating device indicating a toner near empty indication when the communication part receives a toner near empty indication instruction signal which instructs that the toner near empty indication should be indicated on the indicating device from the controlling device which has received the toner near empty signal, and the indicating device not indicating the toner near empty indication when the communication part does not receive the toner near empty indication instruction signal although the toner near empty signal is output to the controlling device, the controlling device having a controlling condition table recording a controlling condition set for each image forming device to be controlled, the controlling condition being a condition that an automatic delivery contract to deliver a toner cartridge replacement to a user of the image forming device when the toner near empty state is detected in the image forming device is made, or the automatic delivery contract is not made, and a communication part for communicating with the image forming device to be controlled via the communication network, the controlling device refers to the controlling condition for controlling the image forming device recorded in the controlling condition table for the image forming device when the communication part receives the toner near empty signal from the image forming device to be controlled, and as for the image forming device which transmits the toner near empty signal, if the condition for controlling the image forming device recorded in the controlling condition table includes the condition that the automatic delivery contract is made, and not outputting the toner near empty indication instruction signal to the image forming device, but outputting a delivery instruction signal to a toner cartridge delivery control device for instructing the toner cartridge delivery control device to deliver the toner cartridge replacement to the user of the image forming device, and in a case where the condition for controlling the image forming device recorded in the controlling condition table does not include the condition that the automatic delivery contract is made, outputting the toner near empty indication instruction signal to the image forming device.

15. A non-transitory computer-readable recording medium having a program recorded thereon for making a computer comprised in the controlling device for an image forming device in the system for controlling the image forming device according to claim 1 execute the steps of:

receiving the toner near empty signal from the image forming device to be controlled, referring to the condition for controlling the image forming device recorded in the controlling condition table in the controlling device for the image forming device upon receipt of the toner near empty signal from the image forming device, outputting the delivery instruction signal to the toner cartridge delivery control device for instructing the toner cartridge delivery control device to deliver the toner cartridge replacement to the user of the image forming device without outputting the toner near empty indication instruction signal to the image forming device, as for the image forming device which transmits the toner near empty signal, if the condition for controlling the image forming device recorded in the controlling condition table includes the condition that the automatic delivery contract is made, and outputting the toner near empty indication instruction signal to the image forming device, as for the image forming device which transmits the toner near empty signal, if the condition for controlling the image forming device recorded in the controlling condition table includes the condition that the automatic delivery contract is not made.

16. A non-transitory computer-readable recording medium having a program recorded thereon for making a computer comprised in the controlling device for an image forming device according to claim 2 execute the steps of:

receiving the toner near empty signal from the image forming device to be controlled, referring to the condition for controlling the image forming device recorded in the controlling condition table in the controlling device for the image forming device upon receipt of the toner near empty signal from the image forming device, outputting the delivery instruction signal to the toner cartridge delivery control device for instructing the toner cartridge delivery control device to deliver the toner cartridge replacement to the user of the image forming device without outputting the toner near empty indication instruction signal to the image forming device, as for the image forming device which transmits the toner near empty signal, if the condition for controlling the image forming device recorded in the controlling condition table includes the condition that the automatic delivery contract is made, and outputting the toner near empty indication instruction signal to the image forming device, as for the image forming device which transmits the toner near empty signal, if the condition for controlling the image forming device recorded in the controlling condition table includes the condition that the automatic delivery contract is not made.

* * * * *